United States Patent [19]

Simon

[11] 3,967,560

[45] July 6, 1976

[54] BENDING BEAM AND METHOD OF MAKING SAME

[75] Inventor: Michael Simon, Munich, Germany

[73] Assignee: Maschinenfabrik Augsburg-Nurnberg AG, Germany

[22] Filed: Apr. 3, 1974

[21] Appl. No.: 457,499

[30] Foreign Application Priority Data

Apr. 3, 1973 Germany ..... 2316462

[52] U.S. Cl. ..... 104/94; 52/724; 104/108; 104/118; 105/141; 138/117; 138/177; 138/178

[51] Int. Cl.[2] ..... E04C 3/293; E01B 25/22; B61B 3/00; B61B 5/00

[58] Field of Search ..... 104/89–95, 104/106–111, 118–121, 138 R, 139, 143; 238/133, 134, 141, 150, 143–148, 283; 105/141, 144–150, 152–155; 138/111–117, 148, 149, 175–178; 52/722–725, 727

[56] References Cited

UNITED STATES PATENTS

| | | | |
|---|---|---|---|
| 980,191 | 1/1911 | Boynton | 104/121 |
| 1,340,454 | 5/1920 | McClenahan | 238/134 |
| 1,977,371 | 10/1934 | Bauer | 52/723 |
| 3,059,588 | 10/1962 | Chadenson | 104/94 |
| 3,090,326 | 5/1963 | Goodell et al. | 104/107 X |
| 3,236,192 | 2/1966 | Esquillan | 104/108 X |
| 3,291,394 | 12/1966 | Wheeler | 238/143 |
| 3,385,015 | 5/1968 | Hadley | 52/724 X |
| 3,550,339 | 12/1970 | Yanai | 138/111 X |

FOREIGN PATENTS OR APPLICATIONS

| | | | |
|---|---|---|---|
| 1,132,701 | 1962 | Germany | 52/724 |
| 931,127 | 7/1963 | United Kingdom | 104/94 |
| 817,993 | 8/1959 | United Kingdom | 104/120 |

*Primary Examiner*—John J. Love
*Assistant Examiner*—Andres Kashnikow
*Attorney, Agent, or Firm*—Craig & Antonelli

[57] ABSTRACT

Bending beam arrangement for use in supporting elevated trains and the like, and method of making same. The profile member beam is formed as a composite structure having steel profilemember and a concrete profile member connected thereto. The concrete profile member is disposed and configured so as to maximally absorb the compression forces experienced by the bending beam while minimizing the total cross sectional area of the concrete so that the overall weight of the bending beam is maintained at a minimal level. By absorbing the compressive forces on the composite beam and thereby preventing buckling of the steel beam, a thin walled steel beam construction can be utilized hence substantially only significant tensile forces need be accommodated thereby. Various preferred geometrical embodiments are included with means being provided in each embodiment to accommodate supporting and guiding of an elevational or suspended train vehicle for movement therealong. Several preferred embodiments include closed profile steel girders having the concrete profile girder disposed inside the hollow space formed thereby. Other preferred embodiments of open steel beam construction are also included. In one preferred embodiment two pipes of different sizes are arranged one inside the other to form the steel profile member with a hollow space formed between the two pipes being filled with concrete constituting the compressive reinforcing concrete girder. In this last-mentioned embodiment, a longitudinal slot through both pipes is provided at the contact surface thereof for accommodating suspension of a train vehicle. The hollow space inside of the inner tube or pipe accommodate guide wheels for the vehicle as well as driving mechanisms and other support equipment. The method of manufacturing preferred embodiments of the composite steel concrete beam include controlling the temperature of the concrete mixture during curing so as to prevent formation of stresses due to dimensional changes in the concrete during curing.

24 Claims, 18 Drawing Figures

FIG. 1
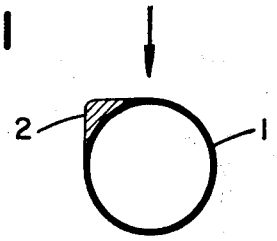
FIG. 2
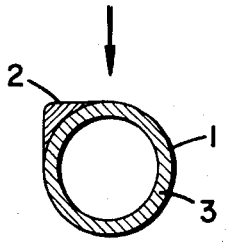
FIG. 3
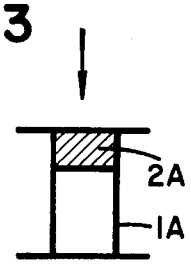
FIG. 4
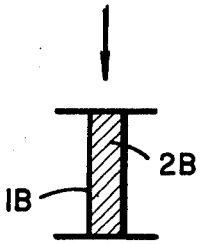
FIG. 5
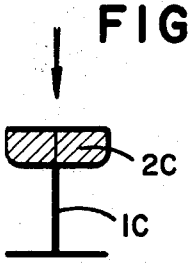
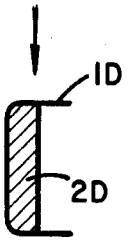
FIG. 6
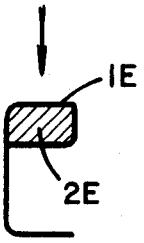
FIG. 7
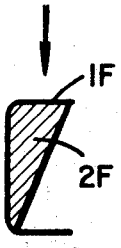
FIG. 8
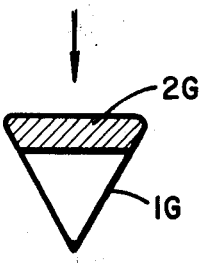
FIG. 9
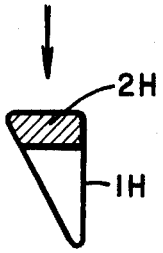
FIG. 10
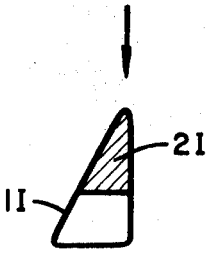
FIG. 11

FIG. 15
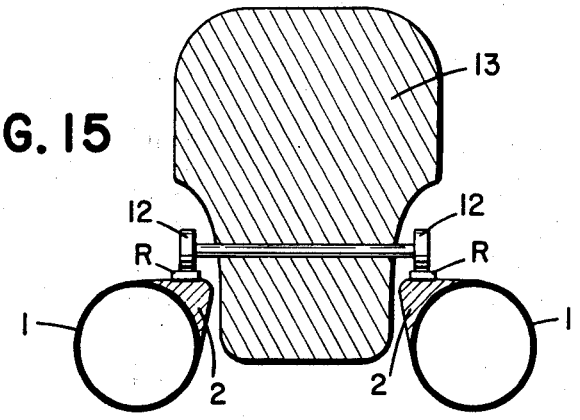
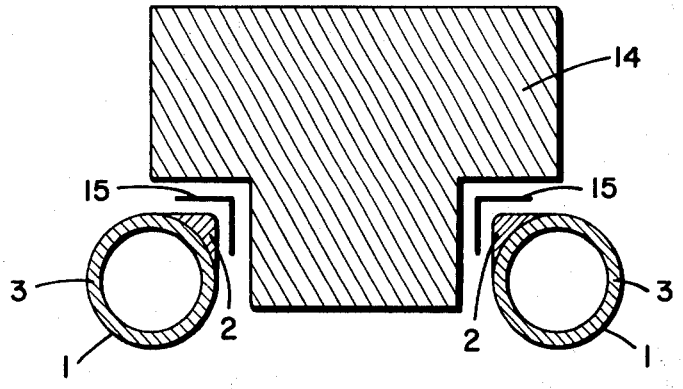
FIG. 16
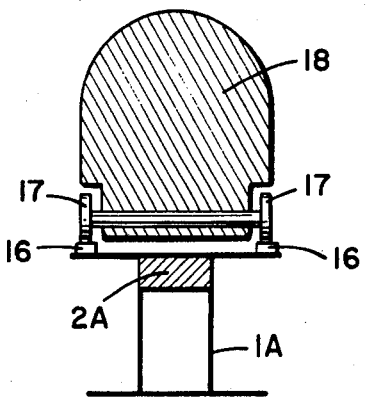
FIG. 17
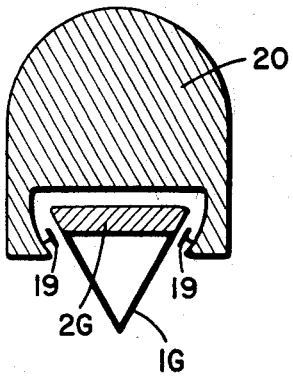
FIG. 18

BENDING BEAM AND METHOD OF MAKING SAME

BACKGROUND AND SUMMARY OF THE INVENTION

This invention relates to a bending beam (transverse beam, cradle), especially for elevated train structures, consisting of at least respectively one structural girder of metal, particularly steel, and a nonmetallic material, especially concrete.

Bending girders, especially bending girders with a high extreme fiber distance (edge-to-axis spacing) and great accuracy requirements, are generally manufactured from steel, resulting in a number of difficulties. Thus, buckling occurs, for example, in thin-walled cross sections under compressive stress which considerably impairs the geometry and accuracy of the cross section, without the strength limit of the material having been exceeded in individual aspects. Furthermore, such steel beams tend to show only insufficiently damped resonance oscillations, because of the large Hooke's range (proportional limit) of certain types of steel when scantily designed (designed with minimum total cross-sectional area). Also, unduly high forces occur at the points of application of the bending forces, since at these points the load is not effective on the entire cross section of the beam. These troublesome phenomena have been counteracted either by designing the entire structural profile very generously, which results in high additional costs due to the price of steel, or by welding or riveting partial reinforcements to the endangered points which, in turn, leads to a significant increase in costs because of the additional work connected therewith.

In part, such steel bending beams act like the resonators of musical instruments with respect to sound vibrations introduced into the beams, which should be avoided for the sake of environmental protection (noise abatement).

By the use of pure steel-concrete beams, the abovementioned disadvantages can be partially reduced or avoided, as long as the extremely high inherent weight of such a beam does not play a decisive part.

When considering bending beams for elevated trains, a construction of the train support structure in concrete would normally be practicable only in case of favorable ground conditions due to weight. However, at least on soft ground, steel girders must be used which, due to the great extreme fiber distance of about one meter and supporting widths of about 20 meters show a high discrepancy between the wall thicknesses resulting when considering the stresses occurring only in the longitudinal direction of the profile and the wall thicknesses which ensure buckling strength. Taking the entire stresses into account; with a maximally permissible limit of sagging of 2 mm. per supporting width, even a partial, actually otherwise harmless buckling at force application points will result in damage.

It is known from German Pat. No. 701,175 to impart greater tensile strength to iron frames by a coaxial lining with nonmetallic material, in order to save steel and thus expenses in this way. However, this invention cannot be applied to the bending beam since, for weight reasons, the insertion of a concrete pipe into an iron tube brings more disadvantages than advantages. In particular, with the pipe diameters of 1–2 meters necessary for elevated train routes, an internal pipe which is self-supporting and distributes the stresses resulting from the points of force application must have a wall thickness of several centimeters; thus, no appreciable advantage with respect to the weight is achieved over a steel-concrete mode of construction.

It is an object of this invention to provide bending beams, particularly with a high extreme fiber distance, which afford a minimum steel cross section with a low total weight and without partial metal reinforcement, and offer the possibility of the introduction of individual stresses without deformation. Additionally, the bending beam is to attenuate vibrations and sound oscillations introduced therein, and the total costs are to be kept at a minimum.

This object is attained, according to this invention, by providing that the structural girder or girders of metal are reinforced by structural girders of a nonmetallic material at the places under compressive stress and/or under buckling stress, as well as at the force application points of the bending beam. In this construction, the structural girder of a nonmetallic material, especially concrete, supports the cross sections under buckling stress due to compressive forces, to which cross sections, the structural girder is joined by a casting process by means of reinforcing beads pressed into the cross sections. The nonmetallic material absorbs compressive stresses at buckling points and introduces such stresses again into the steel girder after the buckling point, so that nonuniformities in the nonmetallic profile need not be considered, as long as they do not coincide with a buckling point. Furthermore, a continuous profile, for example of concrete, is less expensive than the mounting of local reinforcements of steel at the main buckling points, and even if a buckling point has not been taken into account inadvertently, no damage is done. The nonmetallic structural girder can moreover be arranged as corrosion protection or heat protection on the main weathering and sunlight side, in order to prevent corrosion or buckling by heat. The bending beam of the present invention is furthermore capable of vibrating to only a very damped extent; this does not only attenuate the noise production when the train passes over the route, but the vibrations are likewise reduced which caused by the periodic travel over supporting columns.

Another embodiment of this invention resides in that the structural girder consists of a nonmetallic material made up of series-arranged individual sections. Since the girder does not have a force-transmitting effect in use in its longitudinal direction, it is possible by this feature of the invention to mount the nonmetallic profiles, such as reinforcing plates additionally to the girder only after the assembly of the metallic profile or profiles, for example into an elevated-train foundation. In this connection, profiled plates with mounting elements for the introduction of forces into the train construction can be prefabricated by mass production and fittingly inserted at the construction site by means of cut-to-order spacer elements.

In accordance with another embodiment of the invention, the metallic structural girder is a pipe to which is mounted a structural girder of a nonmetallic cross section on the outside of one or both quadrants which together form the portion of the structural girder cross section facing the bearing loads. In another preferred embodiment of the invention, the cross section of the structural girder forms essentially a right triangle, wherein the bending beam has on its outside a horizontal contact surface and at least one vertical contact surface. In this connection, a pipe which is particularly inexpensive and has been produced by series production can be used, which, on the one hand, absorbs bending loads and, on the other hand, can serve for receiving, in its interior, supply lines, cargo, and the like, wherein the inner side can be lined with one or more metallic or nonmetallic profiles. The other profile, as it is required, for example, for the mounting of elevated-train mechanisms, is applied to the outside of the pipe, for example by cementing, or is poured onto the roughened or corrugated surface of the pipe.

Another embodiment of the invention resides in that the metallic structural girder has horizontal tensile and compressive zones connected with one another by thin-walled, vertical webs, and that at least one of the webs is associated with a profile element of approximately the same height, made of a nonmetallic material, as the reinforcing means. This makes it possible to design such profiles in the web according to minimally permissible tensile and compressive stresses, since the deflected profile member of nonmetallic material prevents a buckling or crushing of the web. Moreover, the nonmetallic profile is suitable for the absorption of compressive stresses; this makes it possible to design the steel chord facing the bending load, representing the compression zone, to be of a lower strength.

According to a further embodiment of this invention, the metallic profile girder forms a closed hollow contour with at least one horizontal and one vertical outer surface, filled partially by the structural girder of nonmetallic material along its side under the effect of compressive forces. This offers an anchoring possibility for the force application points, as well as safety against buckling. Furthermore, the nonmetallic structural girder can also be provided according to the invention with mounting means serving for the reception of supply lines arranged in the interior of the total profile construction, which lines could otherwise come into harmful mutual contact or could damage the profile wall, such as, for example, raw wire lines for power current.

A further feature of preferred embodiments of this invention provides that the profile member of metal has at least one closed hollow space arranged at least partially in the zone under compressive stress, this hollow space being entirely filled with a nonmetallic material. This makes it possible to introduce, after the assembly of the hollow bending beams, a nonmetallic material which can be pumped subsequently into the hollow space. This reduces the costs of transportation and assembly. Another embodiment of the present invention provides that the profile member of metal is a steel profile in the form of a double-T-girder with a box disposed on the top chord. The box can be formed by a mass-produced U-shaped profile member according to the invention. However, not only series-produced profile members are employed; rather, the attached box forms a track element affording the convenient mounting of rails and distributing all introduced forces absorbed by the double-T-girder.

A preferred embodiment of the present invention which is an alternative of the above-mentioned constructions provides that the steel profile consists of two pipes, one inserted in the other, the walls of which pipes are in contact with each other along a straight line. This arrangement makes it possible, with a given external diameter and with the use of pipes, to surround an internal chamber with an external chamber in the matter of a reinforcing bracket, wherein the internal chamber can serve for the reception of supply lines or cargo, while the outer chamber is filled with a nonmetallic material, offering a rigidifying resistance against bending forces, as well as lateral forces and torsional forces. In accordance with a further development of the invention, the contact zone is located on the side of the pipes facing away from the primary bending forces. The zone of the largest thickness of the nonmetallic profile is disposed exactly in the zone of the compressive forces, whereas the zone of the largest thickness of the metallic profile is arranged in the zone of the tensile forces.

In another arrangement according to the invention, the total profile has a longitudinal slot in the contact zone of the two pipes. This makes it possible to insert or withdraw without difficulties supply lines subsequently into or from the interior of the profile; if the width of the slot is adequate, connection and repair operations can likewise be carried out.

In a further embodiment, both pipes are connected outside of the contact zone, preferably by clamping bolts, wherein the connecting elements (clamping bolts) pass through the nonmetallic profile material. This measure makes it possible to introduce the bending force into the bending beam not only on its topside but also on its bottom side. In this connection, the connecting members prevent that one of the pipes is lifted from the surface of the nonmetallic profile, or that the entire crescent-shaped profile is bent apart with its tips.

Another embodiment of the present invention resides in that profiles or wires for the mounting of wheels and/or current collectors, especially for suspension cars (compartments, cabins) are arranged in the interior of the inner pipe, particularly on one or both sides of the longitudinal slot in close proximity of the contact zone of the two pipes. The wheel suspensions are guided through the longitudinal slot of the profile. The track guidance is advantageous due to the fact that the current wires are accommodated without contact and safe from atmospheric influences and also satisfies requirements for environmental protection, since the rolling noises of the wheels are extensively damped by the sound-attenuating nonmetallic profile. Furthermore, such a profile prevents a derailed train from falling.

A further development of this invention consists in that the nonmetallic profile girder is seamlessly incorporated into the hollow space of the metallic profile and is made up of bulk material which, on the one hand, is capable of being pumped or poured and, on the other hand, has the behavior of a solid, rather than a liquid after compacting, i.e. it absorbs compressive forces and transmits same directionally. This avoids the difficulty encountered when a large-volume material undergoes a setting process, with a perhaps unduly high extent of shrinkage.

The invention furthermore relates to a process for the production of a bending beam according to this invention by a composite steel-concrete cast wherein, during the setting of the concrete, the steel and/or the concrete are tempered (temperature-controlled) so that the finished cast article is free of tension, under consideration of the shrinkage dimensions. Since concrete heats up during setting, an undesired stress condition results during composite casting after cooling of the concrete; this can be prevented in accordance with the process of this invention.

One embodiment of the process resides in that the steel profile is heated. Heating during the relatively short setting period is sufficient. The good heat conductivity of steel is a contributing factor in the reduction of stress formation by nonuniform heating.

If the concrete profile is very simple, as contrasted to the steel profile, or if a coating does not permit the heating of the steel, an alternative embodiment of this invention provides that the setting concrete is being cooled.

Another development of the process of this invention relates to the aspect of incorporating cooling ducts into the concrete for cooling purposes. In this connection, the cooling duct dimensions can be adapted to the shape of the profile. The cooling ducts can be used, after the cast article has been completed, as supply or conveying lines.

These and further objects, features and advantages of the present invention will become more obvious from the following description when taken in connection with the accompanying drawings which show, for purposes of illustration only, several embodiments in accordance with the present invention.

BRIEF DESCRIPTION OF THE DRAWINGS

FIGS. 1 to 13 are schematic cross sectional views of bending beam arrangements constructed in accordance with respective preferred embodiments of the invention;

FIG. 15 is a part-sectional schematic view illustrating support of a train vehicle at a pair of beam arrangements constructed in accordance with the preferred embodiment of FIG. 1;

FIG. 16 is a part-sectional view depicting guiding support of a train vehicle on a pair of beam arrangements constructed in accordance with the preferred embodiment of FIG. 2;

FIG. 17 is a part-sectional schematic view depicting support of a train vehicle at a beam arrangement constructed in accordance with the embodiment of FIG. 3; and FIG. 18 is a part-sectional schematic view depicting support of a train vehicle at a beam arrangement constructed in accordance with the preferred embodiment of FIG. 9.

DETAILED DESCRIPTION OF THE DRAWINGS

Figure 12:
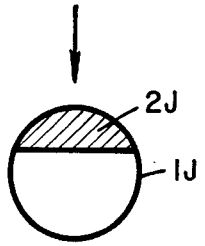

Throughout the various views, like reference numerals are used to depict like structures.

In the embodiment of FIG. 1, a steel cylindrical pipe profile girder member 1 is provided with a concrete profile girder member 2 at the outer surface thereof. This concrete profile member 2 exhibits horizontal and vertical contact surfaces for accommodating guiding support of an overhead train vehicle or the like. In this connection, see FIGS. 15 and 16 for a showing of the relative positioning of the girder members and the train vehicle. It is further noted that each of the bending beam constructions of the present invention are to be supported, in use, at respective spaced vertical supports. Since during use, vertical forces are applied in the downward direction on the bending beams, as depicted by the dark arrows in each of the Figures, it will be understood that the upper portions of the beams will experience compressive stresses and the lower portions of the beams will experience tensile stresses when the beams are acting as bending beams (that is, when the beams have a vertically downward force applied at a position spaced from the relatively fixed vertical supports of the beams). In the embodiment of FIG. 1, the concrete girder member portion 2 is located in the area experiencing compressive forces so that the thickness of the walls of the steel girder member 1 can be designed much thinner than would be the case in the event no concrete girder member were provided, since the thin walled steel member could not by itself withstand the compressive forces even though the experienced tensile forces could be easily withstood thereby.

The FIG. 2 embodiment is similar to the FIG. 1 embodiment except for the addition of a thin lining of concrete 3 on the inside of the steel girder pipe 1, which concrete lining 3 reinforces the steel pipe 1 around the entire periphery thereof. It is further noted with respect to each of the FIG. 1 and 2 embodiments that the load of the train construction and the train is distributed over one quarter of the surface of the pipe at the compressive stress side thereof so that a local inward buckling of the supporting pipe is prevented.

In FIG. 3, steel profile member 1A exhibits a cross section having a closed profile which accommodates concrete girder portion 2A at the upper compressive force side thereof. In this embodiment, the vertical extent of the concrete girder 2A is between ¼ to 1/5 of the vertical height of the overall beam construction, thereby substantially limiting the weight thereof as compared to a beam having a completely filled hollow space, while still optimizing the absorption of compressive forces at the upper side of the beam during use with the experienced bending of the beam.

The FIG. 4 embodiment includes a steel profile member 1B having a I-shaped cross-section with concrete profile girder member 2B extending along the vertical web of the steel girder 1B.

The FIG. 5 embodiment also exhibits a I-shaped steel girder member 1C, however the concrete girder member portion 2C extends at both sides of the central vertical web and extends downwardly only a distance corresponding to ¼ to 1/5 of the vertical height of the girder member 1C.

Each of the embodiments of FIGS. 6 to 8 include a steel profile girder member 1D, 1E, 1F having a U-shaped cross section with the legs of the U extending horizontally. In the FIG. 6 embodiment, the concrete girder member portion 2D extends from the top to the bottom of the vertical web of the steel girder member 2D. In the FIG. 7 embodiment, the concrete girder member portion 2E is of rectangular configuration and extends over the entire horizontal width of the upper web member and extends downwardly along the vertical web member a distance between ¼ and 1/5 of the vertical height thereof. This FIG. 7 embodiment, as discussed above for the FIG. 3 and 5 embodiments, optimally utilizes the concrete for absorbing compressive stresses while minimizing the total cross sectional area, and thereby the weight, thereof. In the embodiment of FIG. 8, the concrete girder member 2F is of triangular shape and tapers from a maximum at the top for accommodating the maximum compressive forces experienced thereat with a minimum zero width at the bottom where maximum tensile forces are experienced in use.

In the FIG. 9 embodiment, an isoceles triangular configuration steel profile member 1G encloses a hollow space having the concrete profile girder member portion 2G adjacent the top thereof. As best shown in FIG. 18, this FIG. 9 embodiment is configured so as to form a single beam support for a rail vehicle.

In the embodiment of FIG. 10, a right triangular configuration steel profile member 1H is provided which encloses a space accommodating concrete girder member portion 2H at the upper portion thereof. In the FIG. 11 embodiment, a right triangle shaped girder member 1I is provided which encloses a space accommodating concrete girder member portion 2I at the upper portion thereof. FIG. 11 differs with respect to FIG. 10 in that the concrete girder portion is at the apex of the triangle, while the FIG. 10 embodiment exhibits a concrete girder member 2H adjacent a flat horizontal surface of the triangle. Each of the embodiments of FIGS. 10 to 11 exhibit the advantageous feature of havng the concrete girder member portion positioned only at the compression side of the steel girder member so as to minimize the total amount of concrete used as well as to leave an open space for accommodating passage of auxiliary supply lines and the like through the profile member 1G. In each of these embodiments of FIGS. 9 to 11 the vertical extent of the concrete girder member is preferably between ¼ and 1/5 of the total vertical height of the steel girder member.

The embodiment of FIG. 12 exhibits a cylindrical tubular cross section steel profile member 1J enclosing a concrete profile member 2J extending along a portion of the upper half of the inside of the steel tubular member. This FIG. 12 embodiment is particularly advantageous with respect to ease of construction in view of the availability of tubular steel members and in view of the ease with which concrete can be poured into the bottom of such a pipe, with a subsequent inversion of the pipe so that the compression reinforcing concrete is at the topside thereof in use.

Figure 13:
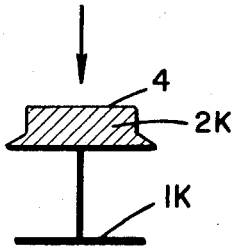

In the embodiment of FIG. 13, an I-shaped steel profile member 1K is provided which has a box shaped enclosure 4 at the top thereof for accommodating concrete girder profile member 2K. This embodiment is also relatively easy to construct and exhibits the abovementioned advantages regarding maximizing resistance to compressive stresses while minimizing the overall cross sectional dimensions of the concrete. In this FIG. 13 embodiment, the hollow space inside box 4 is completely filled.

Figure 14:
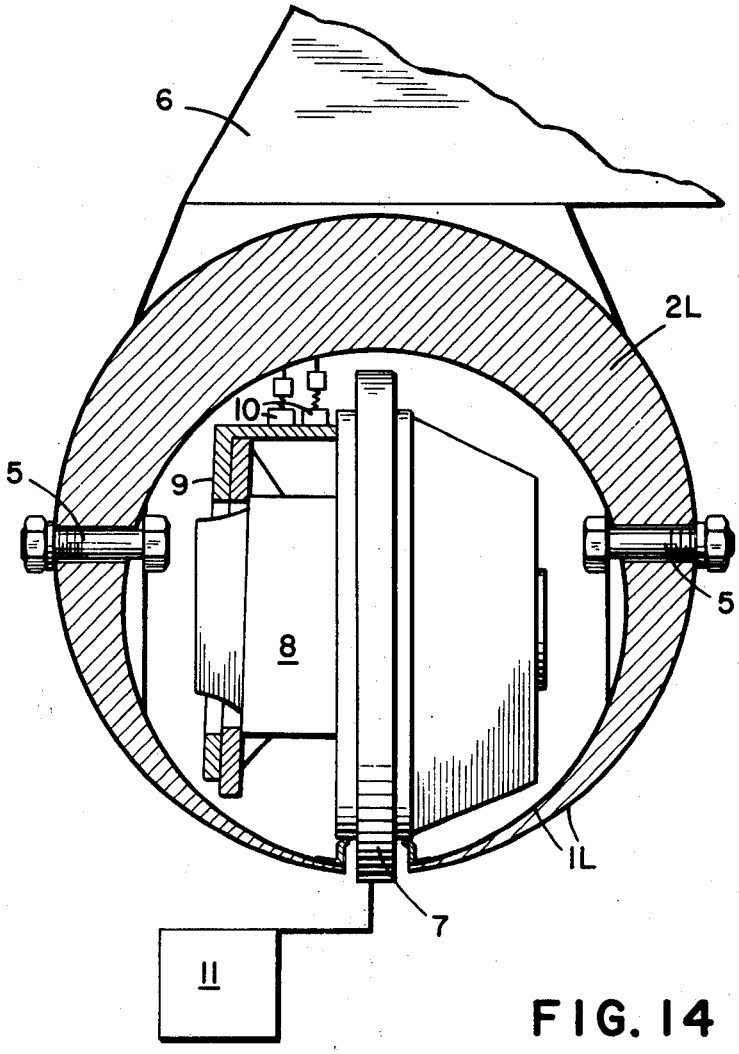
FIG. 14 is a part-sectional schematic view of a beam arrangement constructed in accordance with another preferred embodiment of the invention in conjunction with support and guide mechanisms for a suspended train vehicle.

In the preferred embodiment of FIG. 14, the steel profile member 1L is formed of two pipes, one inside the other. The smaller pipe is dimensioned so as to leave an opening for the concrete girder member 2L between the two pipes when the pipes are in engaging contact in a contact zone along the bottom thereof. These pipes are connected to one another along this contact zone, as well as at a position intermediate the vertical height of the pipes by way of clamping bolts 5 which also extend through portions of the concrete girder 2L. These clamping bolts 5 are advantageous in distributing the forces to the compression side of the bending beam when loaded as shown in FIG. 14 by schematically depicted drive wheel 7, which is in turn attached to the carriage and vehicle train 11. As can be seen in FIG. 14, the drive wheels 7 are supported at respective opposite side of the longitudinally extending slot at the bottom center portion of the composite bending beam. The hollow space within the inner pipe accommodates, in addition to the drive wheel 7, an electric drive motor 8, wheel bogie 9 and electric current rails 10. The electric current rails 10 provide driving power to the vehicle wheels by way of the bogie 9. In view of the enclosure of the drive wheels and electric supporting apparatus within the inner pipe, adverse effects of outside weather conditions are avoided and sound emanation to the outside surroundings due to the relatively moving parts is minimized. Reinforcing plates extend downwardly on the inside from the bolts 5 to further assist in reinforcing the connection of the two pipes as well as transfer of bending forces to the compressive zone at the upper portion of the composite beam where the maximum thickness of the concrete girder 2L is provided. Reference numeral 6 depicts an overhanging support for the composite beam structure, which member 6 is further supported at vertical support columns laterally thereof, not shown.

FIG. 15 schematically depicts positioning of a pair of bending beam arrangements constructed in accordance with the FIG. 1 embodiment for supporting a railway vehicle 13 by way of tracks or guide rails R provided at the upwardly facing horizontal surface of the concrete girder members 2. Wheels 12 of the vehicle 13 travel along these rails R.

FIG. 16 schematically depicts support of a train vehicle 14 at a pair of bending beam arrangements constructed in accordance with FIG. 2. In this FIG. 16 arrangement, magnet suspension means schematically depicted at 15 are provided for supporting the vehicle 14.

In the arrangement of FIG. 17, a single bending beam arrangement constructed in accordance with FIG. 3 is provided for supporting narrow gauge train vehicle 18 by way of tracks 16 for wheels 17 at the upper surface of the steel beaam 1A.

FIG. 18 schematically depicts a magnetic suspension arrangement 19 for supporting a train vehicle 20 at a single bending beam arrangement constructed in accordance with FIG. 9.

Although FIGS. 15 to 18 show respective two rail beam and single beam supports for the train vehicles, it will be understood that the various other embodiments can be advantageously utilized in arrangements with either a single or a double rack or guide system arrangement with respective single or pairs of bending beam arrangements. In this connection, it is noted that the non-symmetrical bending beam construction such as in FIGS. 1, 2, 7, 10 and 11 are preferably usable in conjunction with dual beam arrangements such as in FIGS. 15 and 16 with the concrete girder member being optimally located under the respective supporting point at the train vehicle.

However, in the embodiments according to FIGS. 3 to 5, 9, 10 and 13, by providing a width of approximately two meters, both rails of a small gauge railway can be arranged at respective opposite sides of the beam (see FIG. 17).

In each of the preferred embodiments described above, the overall height of the beam arrangement is preferably between one and 2 meters, while the wall thickness of the steel is between 1 and 2 centimeters. In the embodiment of FIG. 14, the center of the inner pipe lies approximately 10 to 20 centimeters below the center of the outer pipe with the geometrical circles of the pipe walls positioned so as to maximally touch each other at the point vertically below the centers. The longitudinal slot opening in the contact zone is preferably between 10 to 20 centimeters wide. With the arrangement of FIG. 14 having an outer diameter of the outer pipe of approximately 1 meter, single track vehicles can be supported as shown in FIG. 14.

Following is a description of a preferred embodiment of a process for manufacturing a composite concrete-steel beam in accordance with the present invention. First, a steel beam constructed according to the arrangement of FIG. 4 and being 10 meters long and 2 meters high is arranged on the ground or local support surface in such a way, as if FIG. 4 were rotated through 90° so that the top and lower part depicted in FIG. 4 form vertical sidewalls which are connected by a horizontal wall (presently the vertical wall or web in FIG. 4). Into the space below the level wall hot steam is directed which has a temperature of approximately 180°C. Fast hardening concrete, having a temperature of approximately 40°C, is quickly applied at the level horizontal wall until a thickness of approximately 40C of concrete is reached. This application of the fast hardening concrete is preferably completed in five minutes or less. Upon the completion of the point of the concrete, the surface of the concrete is covered with a plastic tilt or canopy and this plastic tilt is sprayed with cooled water while the space below the level wall is heated by steam until the concrete has finished its hardening process which is completed in approximately half an hour.

The above described process is given by way of example only, it being understood that the invention contemplates other specific processes whereby the concrete temperature is controlled so as to relate the thermal expansions and contractions due to curing of the concrete with the outside heat applied so as to minimize tension forces in the composite beam construction.

While I have shown and described several embodiments in accordance with the present invention, it is understood that the same is not limited thereto but is susceptible of numerous changes and modifications as known to those skilled in the art and I therefore do not wish to be limited to the details shown and described herein but intend to cover all such changes and modifications as are encompassed by the scope of the appended claims.

I claim:

1. Bending rail guiding arrangement for an elevated train vehicle comprising: a bending guide rail formed from an integral metal structural girder, and a plurality of non-metal structural girders connected to said metal girder, said plurality of non-metal girders being constructed from concrete and disposed in a series arranged manner to reinforce those portions of the metal girder subject to compressive forces and buckling stress during use of the rail guiding arrangement, said non-metal girders exhibiting an outwardly facing contact surface for accepting loads on the beam arrangement; and train guiding means mounted on said bending guide rail.

2. An arrangement according to claim 1, wherein said train guiding means is mounted on said outwardly facing contact surface for accommodating guiding support of an elevated train vehicle.

3. Bending rail guiding arrangement for an elevated train vehicle comprising a metal structural girder constructed as a pipe and a plurality of concrete girders mounted in series on the outside of said pipe on at least one of the quadrants of the pipe cross section which faces the bearing load on the beam arrangement during use to reinforce the metal girder subject to compressive forces and buckling stress during use of the rail guiding arrangement, wherein said concrete girders have substantially right triangle cross-sections and wherein the concrete girders have horizontal and vertical outwardly facing contact surfaces for accepting loads on the beam arrangements.

4. Bending rail guiding arrangement for an elevated train vehicle comprising a metal structural girder, said metal girder having a cross section exhibiting horizontally extending tensile and compressive zones joined together by thin-walled vertical web means, and a plurality of non-metal structural girders connected to said metal girder, said plurality of non-metal girders being constructed from concrete and disposed in a series arranged manner as reinforcing elements at said vertical web means to reinforce the metal girder subject to compressive forces and buckling stress during use of the rail guiding arrangement, said non-metal girders extending from said compressive zone to a position spaced vertically from said tensile zone.

5. An arrangement according to claim 4, wherein said non-metal girders vertically extend a distance equal to ¼ to 1/5 of the height of said metal girder.

6. An arrangement according to claim 4, wherein the vertical height of said non-metal girders is equal to the entire height of the vertical web means.

7. An arrangement according to claim 4, wherein said metal girder exhibits a U-shaped cross section having the legs of the U forming respective horizontal compressive and tensile zones and the bridge of the U forming the vertical web means.

8. An arrangement according to claim 7, wherein said non-metal girders extend over the full height of the vertical web means.

9. An arrangement according to claim 8, wherein said non-metal girders are uniformly tapered along the lengths thereof from a maximum thickness at the top adjacent the leg forming the compressive zone to zero thickness at the bottom leg forming the tensile zone.

10. An arrangement according to claim 7, wherein said non-metal girders extend from the leg forming the compressive zone downwardly to between ¼ and 1/5 of the total vertical height of the metal girder.

11. Bending rail guiding arrangement for an elevated train vehicle comprising a metal structural girder, said metal girder exhibiting a closed hollow profile with at least one horizontal and one vertical outer surface, and a plurality of non-metal structural girders connected to said metal girder, said plurality of non-metal girders being constructed from concrete and disposed in a series arranged manner to reinforce the metal girder subject to compressive forces and buckling stress during use of the rail guiding arrangement, said non-metal girders partly filling the inside of said hollow profile and extending from the side of the hollow profile under compressive stress in use to a position spaced from the side of the hollow profile under tensile stress in use.

12. An arrangement according to claim 11, wherein said hollow profile is of right triangle shape, and wherein the apex of said triangle is at the side under maximum compressive stress in use.

13. An arrangement according to claim 11, wherein said hollow profile is triangular in shape, and wherein said tensile stress is maximum at an apex of said triangle in use.

14. Bending rail guiding arrangement for an elevated train vehicle comprising: a bending guide rail formed from an integral metal structural girder constructed as a pipe, and a plurality of concrete girders mounted in series on the outside of said pipe on at least one of the quadrants of the pipe cross section which faces the bearing load on the beam arrangement during use, wherein said concrete girders have substantially right triangle cross-sections and wherein the concrete girders have horizontal and vertical outwardly facing contact surfaces for accepting loads on the beam arrangement.

15. Bending rail guiding arrangement for an elevated train vehicle comprising: a bending guide rail formed from an integral metal structural girder having a cross section exhibiting horizontally extending tensile and compressive zones joined together by thin-walled vertical web means, and a plurality of non-metal structural girders connected to said metal girder, said plurality of non-metal girders being constructed from concrete and disposed in a series arranged manner as reinforcing elements at said vertical web means to reinforce those portions of the metal girder subject to compressive forces and buckling stress during use of the rail guiding arrangement, said non-metal girders extending from said compressive zone to a position spaced vertically from said tensile zone; and train guiding means mounted on said bending guide rail.

16. An arrangement according to claim 15, wherein said non-metal girders vertically extend a distance equal to ¼ to 1/5 of the height of said metal girder.

17. An arrangement according to claim 15, wherein the vertical height of said non-metal girders is equal to the entire height of the vertical web means.

18. An arrangement according to claim 15, wherein said metal girder exhibits a U-shaped cross section having the legs of the U forming respective horizontal compressive and tensile zones and the bridge of the U forming the vertical web means.

19. An arrangement according to claim 18, wherein said non-metal girders extend over the full height of the vertical web means.

20. An arrangement according to claim 18, wherein said non-metal girders are uniformly tapered along the lengths thereof from a maximum thickness at the top adjacent the leg forming the compressive zone to zero thickness at the bottom leg forming the tensile zone.

21. An arrangement according to claim 18, wherein said non-metal girders extend for the leg forming the compressive zone downwardly to between ¼ and 1/5 of the total vertical height of the metal girder.

22. Bending rail guiding arrangement for an elevated train vehicle comprising: a bending guide rail formed from an integral metal structural girder exhibiting a closed hollow profile with at least one horizontal and one vertical outer surface, and a plurality of non-metal structural girders connected to said metal girder, said plurality of non-metal girders being constructed from concrete and disposed in a series arranged manner to reinforce those portions of the metal girder subject to compressive forces and buckling stress during use of the rail guiding arrangement, said non-metal girders partly filling the inside of said hollow profile and extending from the side of the hollow profile under compressive stress in use to a position spaced from the side of the hollow profile under tensile stress in use; and train guiding means mounted on said bending guide rail.

23. An arrangement according to claim 22, wherein said hollow profile is of right triangle shape, and wherein the apex of said triangle is at the side under maximum compressive stress in use.

24. An arrangement according to claim 22, wherein said hollow profile is triangular in shape, and wherein said tensile stress is maximum at an apex of said triangle in use.

* * * * *